US006250116B1

(12) United States Patent
Groshens

(10) Patent No.: US 6,250,116 B1
(45) Date of Patent: Jun. 26, 2001

(54) TEXTILE SUPPORT FOR REINFORCING A SHIRT COLLAR OR SIMILAR PIECE

(75) Inventor: Pierrot Groshens, Flamicourt (FR)

(73) Assignee: Laniere de Picardie (FR)

( * ) Notice: Subject to any disclaimer, the term of this patent is extended or adjusted under 35 U.S.C. 154(b) by 0 days.

(21) Appl. No.: 09/236,670

(22) Filed: Jan. 26, 1999

(30) Foreign Application Priority Data

Jan. 28, 1998 (FR) ..... 98 00913

(51) Int. Cl.[7] ..... A41B 3/06

(52) U.S. Cl. ..... 66/171; 66/192; 66/195; 2/129; 2/132

(58) Field of Search ..... 66/83, 84 R, 85 R, 66/84 A, 190, 192, 193, 195; 442/305, 306, 313, 319; 2/129, 132, 134

(56) References Cited

U.S. PATENT DOCUMENTS 5,065,599 11/1991 Groshens ..... 66/84
5,194,320 3/1993 Groshens ..... 428/230

FOREIGN PATENT DOCUMENTS 0 369 046 5/1990 (EP) ..... D04B/21/14
2 462 456 2/1981 (FR) ..... C08L/25/10
2 531 616 2/1984 (FR) ..... A41D/27/06
2 570 577 3/1986 (FR) ..... A41B/3/08
2 609 873 7/1988 (FR) ..... A41B/3/02
2 710 078 3/1995 (FR) ..... D04B/1/14
2 727 136 5/1996 (FR) ..... D06N/7/06
2 755 832 5/1998 (FR) ..... A41D/27/06

*Primary Examiner*—Danny Worrell
(74) *Attorney, Agent, or Firm*—George T. Marcou; Kilpatrick Stockton LLP

(57) ABSTRACT

The invention relates to a textile support (1) for reinforcing a shirt collar or a similar piece of clothing, in the form of a nonwoven textile lap (2) reinforced by a knitted fabric (3) and comprising capstan yarns (4, 5), extending along the warp, between the stitch wales The invention also relates to a shirt collar or similar piece of clothing comprising such a textile support, as well as a process for obtaining such a collar.

27 Claims, 4 Drawing Sheets

TEXTILE SUPPORT FOR REINFORCING A SHIRT COLLAR OR SIMILAR PIECE

The invention relates to a textile support for reinforcing a shirt collar or similar piece, to the application of such a textile support for reinforcing a shirt collar or similar piece, and finally, to a process for obtaining such a collar.

Clothing collars such as shirt collars, blouse collars or similar pieces comprising an interlining are already known.

It can be referred for instance to the documents FR-A-2 570 577 and FR-A-2 609 873.

Conventionally, the interlinings or reinforcement pieces for shirt collars are made of either woven, for example polyester, or nonwoven material.

However, the shortcoming of current shirt collars is that dimensional stability of the shirt cannot be guaranteed perfectly over the time. Indeed, the successive washings of the shirt and hence of the collar will damage the stabilization produced by the collar reinforcement interlining, which causes rather detrimental modification of the collar measurement length. This collar measurement loss may reach 1.5, even 2.5 cm, sometimes more.

According to the state of the art, we are already familiar with reinforcement pieces for localized stiffening of textile (see FR-A-2 531 616), thermofusible interlining materials (see FR-A-2 462 456) and finally thermofusible linings in form of a weft knitted fabric (see FR-A-2 710 078).

According to the state of the art, we are also familiar with thermofusible interlinings in the form of a weft knitted fabric comprising stabilization yarns along the warp.

We also know chemical treatments for textile supports, designed for conferring or improving their resistance to creasing (see FR-A-2 737 136).

The problem at the root of the invention consists in dimensional stabilization of a shirt collar or similar piece, taking into account the regular cleaning of the said piece of clothing, inclusive of the successive washings and ironings.

To this end, the invention implements a textile support for shirt collar or similar piece, in the form of a nonwoven textile lap, reinforced by a knitted fabric comprising a number of stabilization yarns, notably capstan yarns, extending along the warp, between the stitch wales.

According to other characteristics, the stabilization yarns comprise the capstan yarns in the form of simple capstan threads and/or with floats.

According to other characteristics still, the stabilization yarns are distributed over at least one of the faces of the textile support.

The knitted fabric is preferably a warp knit fabric.

The nonwoven textile lap can be made of bonded or slightly bonded fibres.

Conventional processes, for example thermal bonding, fluid jet bonding, needle bonding, pre-needle bonding or chemical bonding can be used for bonding or pre-bonding of the nonwoven textile lap.

Generally, the bonding or pre-bonding process is selected according to the nature of the materials used.

The nonwoven textile lap is made out of natural, synthetic or artificial fibres.

As a variation, it can be made of continuous synthetic or artificial filaments, based for example on polyamide, polyester, viscose or mixtures of the said materials.

The knitted fabric consists of flat yarns and/or fibres, natural, for example cellulosed, synthetic ones, for instance made of polyester or polyamide, notably polyamide 6 or 6.6, or artificial, for example viscose, or mixtures of the said materials.

As a variation, the knitted fabric can be made of synthetic textured multifilament yarns.

The stabilization yarns are made out of flat or textured, natural, synthetic or artificial yarns and/or fibres, such as those described previously, or a mixture of the said materials.

According to an embodiment, capstan yarns are textured yarns, obtained for example by a conventional false twist technique, by using hot water, water steam or hot air or using the air texturing technique.

According to an embodiment, the textile support can also comprise, on at least one of its faces, an adhesive or thermofusible material designed for later association to the collar.

According to another aspect, the invention relates to the application of such a textile support to a shirt collar or similar piece, in order to improve its dimensional stability over the time, notably to resist successive washings and ironings.

Dimensional stability of the collar can be improved in its larger direction, i.e. the neck measurement or, alternately, in its direction perpendicular to the long direction of the collar.

According to another aspect, the invention relates to a shirt collar or similar piece comprising one or several pieces of fabric and at least one assembled textile support such as described previously.

The textile support serves itself either as an interlining or as an interlining reinforcement, in turn connected to the collar piece(s).

The textile support serving itself as an interlining comprises a coating made of adhesive or thermofusible material for connection to the collar piece(s).

In case when the textile support serves as an interlining reinforcement, it can be connected to the interlining by heat sealing, simultaneously to thermobonding of the interlining.

Such an interlining is made of cotton or similar.

According to a first embodiment, notably when dimensional stabilization in the larger direction of the collar is required, the stabilization yarns of the textile support are arranged in the long direction of the collar, i.e. the neck measurement.

In such a case, the warp of the textile support extends along the direction of the collar length.

According to a second embodiment, notably when stabilization in the perpendicular dimension to the large direction of the collar is required, the capstan yarns are arranged in the direction perpendicular to the long direction of the collar.

In such a case, the warp of the textile support extends along the direction perpendicular to the direction of the collar length.

A collar such as described previously may comprise two pieces of fabric, respectively an upper piece and a lower piece, assembled to one another and between which at least one reinforcement textile support has been inserted.

According to another aspect of the invention, a process for production of such a collar, as described previously, is provided, including a stage consisting in assembling at least one textile support such as described to the fabric piece(s) of the collar.

According to a first embodiment variation, the textile support is assembled directly to the fabric piece(s) of the collar.

According to a second possible variation, the textile support is first assembled to an interlining and the interlining, thus reinforced, is then assembled to the fabric piece(s) forming the collar.

The invention will be understood more clearly using the following description, with reference to the appended drawings in which.

Figure 2:
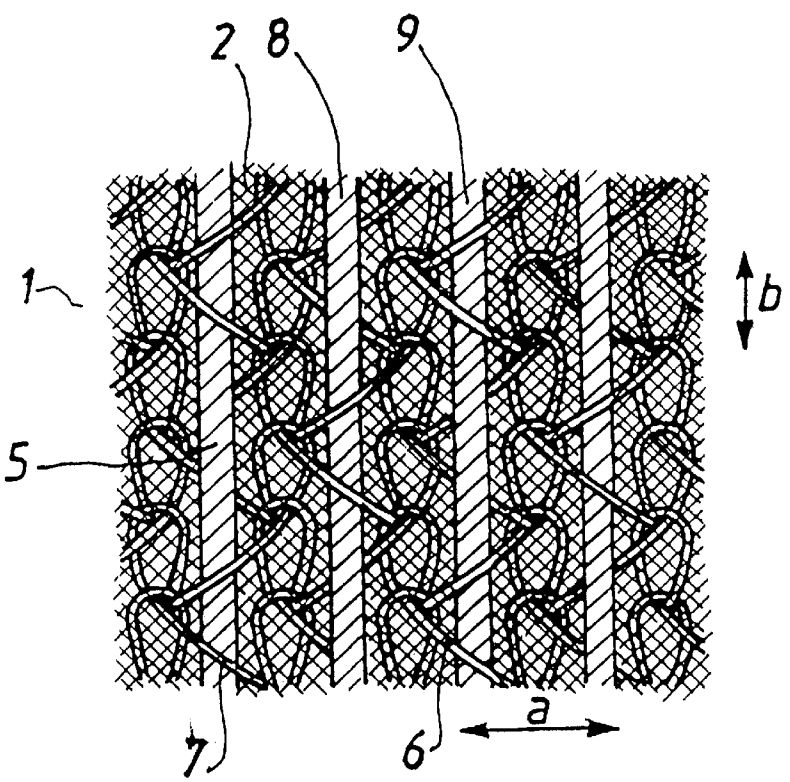
FIG. 2 represents a top and flat, schematic view, of another embodiment of the textile support of the invention.
Figure 1:
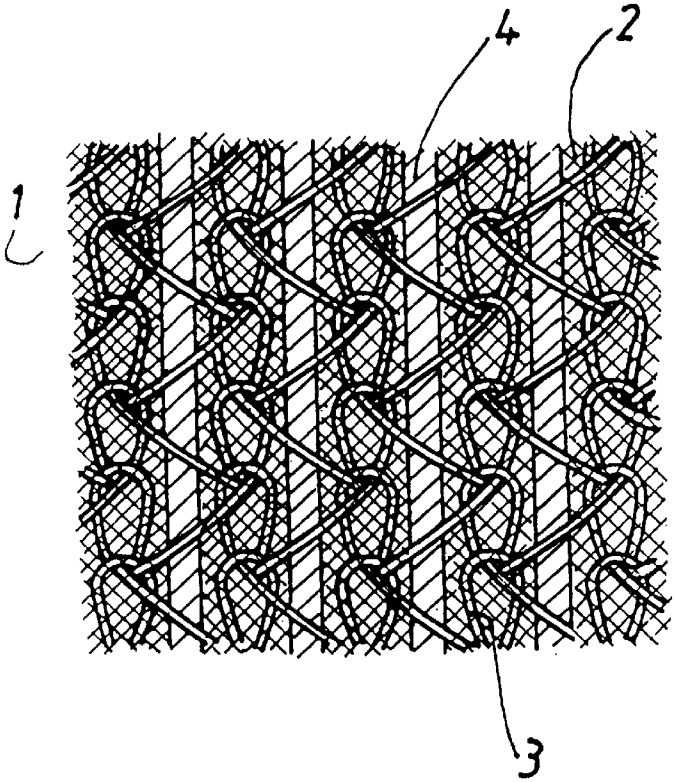
FIG. 1 represents a top and flat, schematic view, of an embodiment of the reinforcement textile support according to the invention.
Figure 6B:
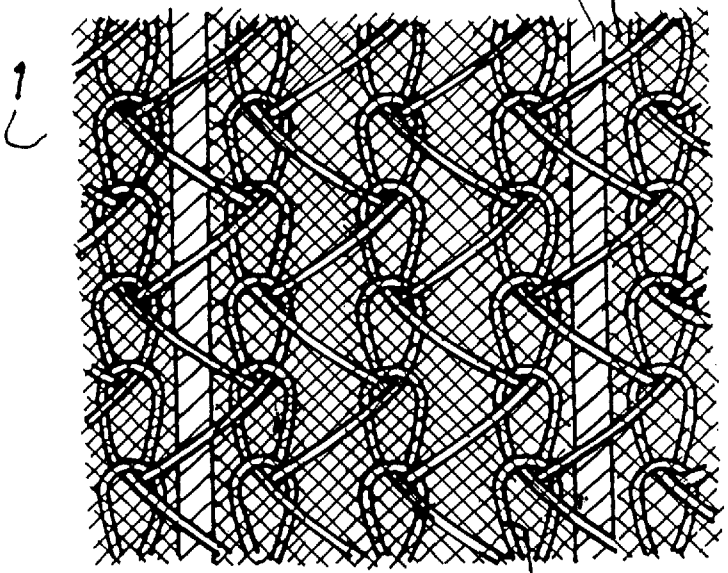
Figure 6A:
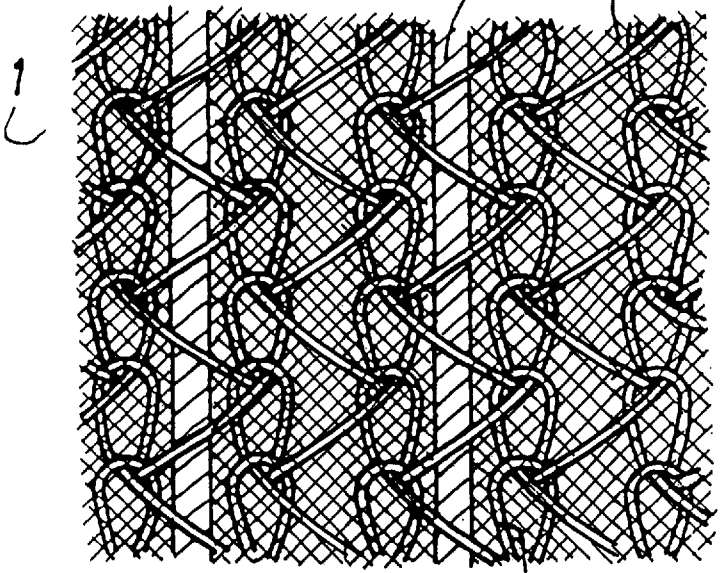
Figure 6C:
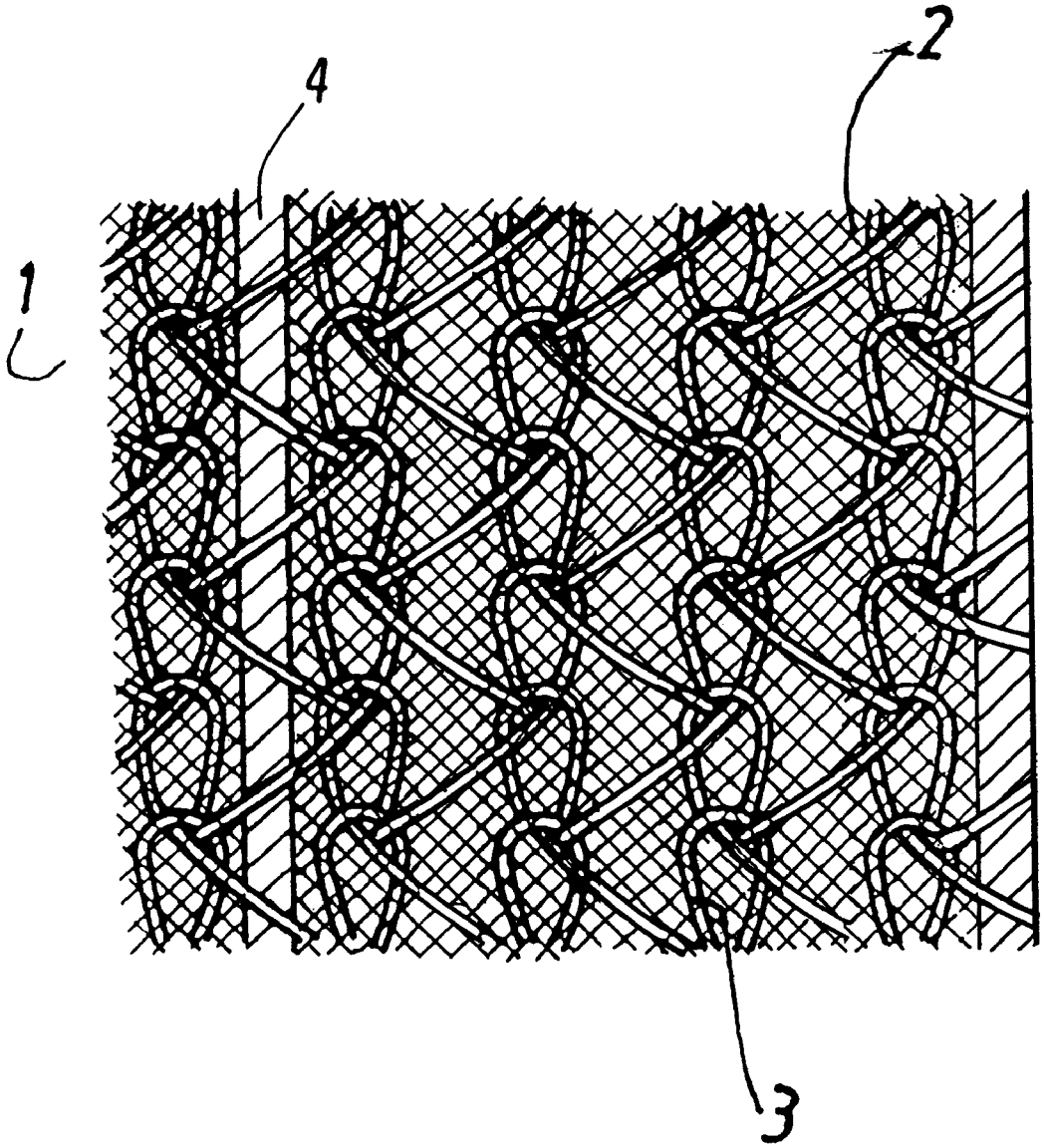

FIGS. 6*a*, 6*b*, and 6*c* illustrate a capstan yarn every two, three, and four stitch wales, respectively, of the reinforcement textile support shown in FIGS. 1 and 2.

The textile support 1 of the invention takes on the shape of a nonwoven textile lap 2 reinforced by a knitted fabric 3.

The knitted fabric 3 is preferably a warp knit fabric.

According to the invention, the knitted fabric 3 comprises, distributed over at least one of its faces, capstan yarns 4.

The textile support 1 may comprise capstan yarns 4 on only one of its faces, whereas the other face is more or less smooth.

According to a peculiar embodiment, the capstan yarns 4 are simple (FIG. 1).

According to another embodiment, the capstan yarns 4 may form over their lengths, in whole or in part, a float 5 (FIG. 2). The float 5 is the relief obtained on yarns when they are not maintained by all the underlap 6 of the knitted fabric 3.

On the embodiments represented in the Figures, a capstan yarn is arranged between each stitch wale. The number of capstan yarns per stitch wale may however vary.

For example, it is possible to provide a capstan yarn every two, three or four stitch wales.

It is also possible to provide several capstan yarns, for example two to four, between each stitch wale, or every two, three or four stitch wales.

The capstan yarns 4 can be located close to one another, at a distance a in the order of a stitch length b.

The length of the floats 5 can be in the order of the length of one to several stitches b, notably in the order of two to five stitches.

The capstan yarns 4, 5 can be distributed regularly over the textile support 1.

It is however possible to provide different distributions of the capstan yarns on the textile support, according to the final usage of the product.

According to an embodiment, the capstan yarns are made of yarns 7 inserted into the fabric 3. In such a case, the yarns with floats 5 can be provided by passing those yarns 7 on the same side of several stitch rows or casts composing the knitted fabric 3.

In this embodiment, the yarns 7 are inserted using conventional means. According to the effects sought-after, the yarns can be rectilinear or parallel to the stitch wales of the fabric or comprise underlap conferring the requested layout. When the yarns pass on the same side of several stitch rows or casts composing the fabric 3, i.e. underlap 6, a float is provided, causing a relief.

The capstan yarns with floats 5 consist of yarns 7 in the direction of the warp and between the stitches, exhibiting for example a float 5 corresponding to at least two stitch rows or casts of the fabric 3.

According to an embodiment (FIG. 2), the floats 5 of two neighboring yarns 8, 9 are offset longitudinally in relation to one another by a length corresponding to the length of a float 5 of a yarn.

Alternately, the floats of two neighboring yarns can be arranged while being aligned with respect to one another, in relation to the stitch rows.

The simple capstan yarns 4 or the capstan yarns with floats 5 can be arranged on the side of the nonwoven textile lap 2 opposite to the side comprising the knitted fabric 3.

The adhesive or thermofusible material can be deposited for example by a coating method, in the form of dots or lines, for instance an coating method by a screen printing.

The adhesive or thermofusible material is for instance any of those currently used to ensure lamination of the reinforcement fabrics on the textiles designed for receiving the said fabrics.

The material can be based on vinyl polymers, polyolefine, polyamide, high and low-density polyethylene, copolymer, copolyamide, etc.

These substances can be provided in the form of powder or paste.

The textile support 1 such as described is especially designed for a shirt collar 10 or any other similar piece and its function consists in improving its dimensional stability over the time, further to its successive washings or ironings.

Figure 3:
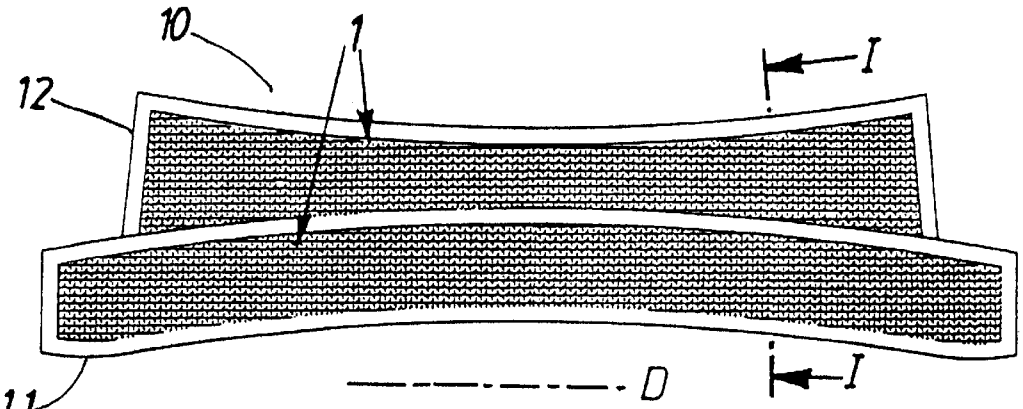
FIGS. 3 and 4 represents two top and flat, schematic views, of a shirt collar or similar piece, including a reinforcement textile support according to the invention.
Figure 4:
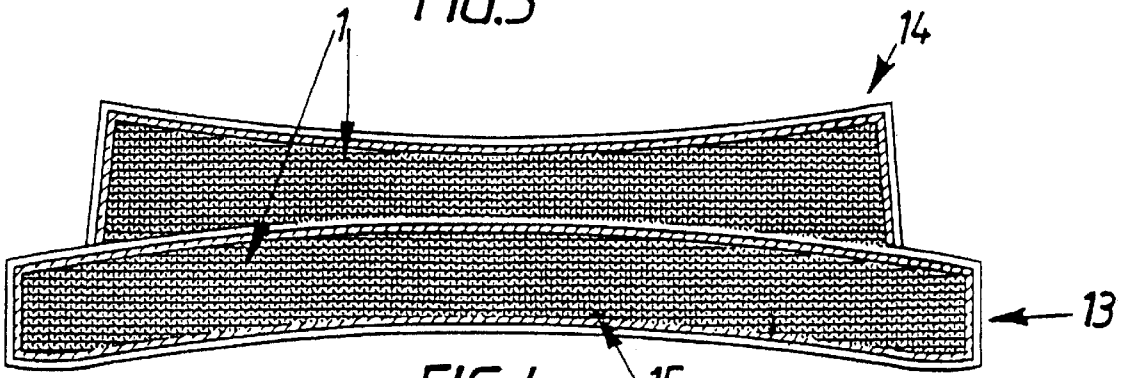
Figure 5:
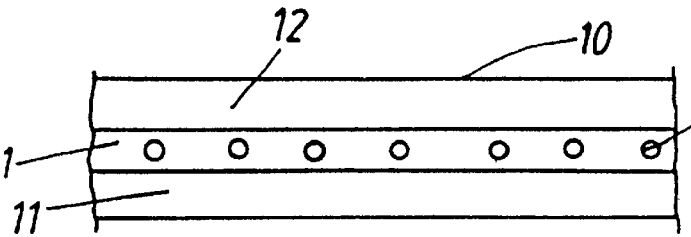
FIG. 5 is a partial sectional view, along line I—I of FIG. 3.

The collar 10 comprises, in the embodiment represented, two parts, respectively an upper part 11 and a lower part 12, assembled to one another and between which is inserted at least one textile support 1 (FIG. 3).

The parts 11, 12 are cut in order to exhibit a part 13 denominated collar band, designed for adjoining the main section of a piece of clothing, and a flap 14.

Both parts 11, 12 are connected to one another by being sewn together at their periphery or thermally bonded.

According to a first embodiment variation, the dimensional stability sought-after is that in the long direction of the said part, referred to as D in FIG. 3, i.e. the neck measurement in this case.

To ensure this stabilization function, the textile support 1 has been arranged on the part 10 with the capstan yarns being arranged in the direction to be stabilized, i.e. the direction D.

According to another embodiment, the dimensional stability sought-after is that acting in the direction perpendicular to the long direction of the collar.

In order to fulfil, in such a case, its stabilization function, the textile support 1 is connected to the collar 10 so that the capstan yarns are arranged in the direction to be stabilized, i.e. the direction perpendicular to the direction D.

According to a first possible embodiment, the textile support 1 serves as an interlining. In such a case, the textile support 1 comprises the coating made of a adhesive or thermofusible material.

According to another possible embodiment, the textile support 1 is connected to an interlining 15, whereas the said interlining is itself connected to the parts 11, 12.

In the latter case, the support 1 is connected to the interlining 15 by a heat sealing process.

Such an interlining 15 can be made, conventionally, of cotton or similar.

As a variation, the textile support 1 can be applied as reinforcement onto a first layer of the same support 1 bonded to the collar fabric.

The process for producing such a collar as previously described consists in including an assembling phase to the parts 11, 12 of at least one textile support 1.

According to the embodiments contemplated, the textile support 1 is either connected directly to the parts 11, 12 or first connected to an interlining 15, whereas the said interlining, thus reinforced, is then itself connected to the parts 11, 12.

What is claimed is:

1. A shirt collar or similar piece of clothing, comprising one or several pieces of fabric and, assembled to, at least one textile support in a form of a nonwoven textile lap reinforced by a knitted fabric, said knitted fabric comprising capstan yarns, extending along the warp between the stitch wales, wherein the capstan yarns are arranged in the long direction or in the direction perpendicular to the long direction of the collar in order to improve dimensional stability of the collar in one of these directions.

2. The shirt collar or similar piece of clothing according to claim 1, characterized in that the capstan yarns comprise simple capstan yarns or capstan yarns with floats.

3. The shirt collar or similar piece of clothing according to claim 1, characterized in that the capstan yarns are distributed over at least one of the faces of the textile support.

4. The shirt collar or similar piece of clothing according to claim 1, characterized in that a length of floats is in an order of a length of at least one stitch.

5. The shirt collar or similar piece of clothing according to claim 1, characterized in that the capstan yarns are distributed over the textile support.

6. The shirt collar or similar piece of clothing according to claim 2, characterized in that the capstan yarns with floats consist of yarns in the direction of the warp and between stitches, exhibiting for example a float corresponding to at least two stitch rows or casts of the knitted fabric.

7. The shirt collar or similar piece of clothing according to claim 2, characterized in that the floats of two neighboring yarns are offset longitudinally with respect to one another by a length corresponding to a length of a float.

8. The shirt collar or similar piece of clothing according to claim 1, characterized in that the nonwoven textile lap can be made of fibers at least slightly bonded.

9. The shirt collar or similar piece of clothing according to claim 8, characterized in that the nonwoven textile lap is made out of natural, synthetic or artificial fibers.

10. The shirt collar or similar piece of clothing according to claim 9, characterized in that the nonwoven textile lap is made out of continuous, synthetic or artificial filaments.

11. The shirt collar or similar piece of clothing according to claim 10, characterized in that the continuous filaments can be based on polyamide, polyester, viscose or mixtures of these materials.

12. The shirt collar or similar piece of clothing according to claim 1, characterized in that the capstan yarns are arranged on a side of the nonwoven textile lap opposite to a side comprising the knitted fabric.

13. The shirt collar or similar piece of clothing according to claim 1, characterized in that the knitted fabric consists of flat, natural, notably cellulosed, synthetic or artificial yarns and/or fibers, or mixtures of these materials.

14. The shirt collar or similar piece of clothing according to claim 1, characterized in that the knitted fabric consists of synthetic textured multifilament yarns.

15. The shirt collar or similar piece of clothing according to claim 1, characterized in that the capstan yarns consist of flat or textured, natural, notably cellulosed, synthetic or artificial yarns and/or fibers, or mixtures of these materials.

16. The shirt collar or similar piece of clothing according to claim 1, characterized in that it comprises at least one capstan yarn per stitch wale.

17. The shirt collar or similar piece of clothing according to claim 1, characterized in that it comprises at least one capstan yarn every two stitch wales.

18. The shirt collar or similar piece of clothing according to claim 1, characterized in that it comprises at least on one of its faces, an adhesive or thermofusible material for later connection to the collar or similar piece of clothing.

19. The shirt collar or similar piece of clothing according to claim 18, characterized in that the adhesive or thermofusible material can be based on vinyl polymers, polyolefine, polyamide, high and low-density polyethylene, copolymer, or copolyamide.

20. The shirt collar or similar piece of clothing according to claim 18, characterized in that the adhesive or thermofusible material is deposited onto the support in a form of dots or lines.

21. The shirt collar or similar piece of clothing according to claim 1, characterized in that it comprises two pieces, respectively an upper piece and a lower piece, assembled to one another and between which at least one textile support has been inserted.

22. The shirt collar or similar piece of clothing according to claim 1, characterized in that it comprises a collar band, designed for adjoining a main section of a piece of clothing, and a flap.

23. The shirt collar or similar piece of clothing according to claim 1, characterized in that the textile support serves itself either as an interlining or as an interlining reinforcement, in turn connected to the piece(s) of the collar or similar piece of clothing.

24. A process for obtaining the shirt collar or similar piece of clothing according to claim 1, comprising a phase consisting of assembling at least one textile support to the piece(s) of the collar or similar piece of clothing.

25. A process according to claim 24, characterized in that the textile support is either connected directly to upper and lower pieces, or connected to an interlining whereas the interlining is then connected to the upper and lower pieces.

26. The shirt collar or similar piece of clothing according to claim 1, characterized in that it comprises at least one capstan yarn every three stitch wales.

27. The shirt collar or similar piece of clothing according to claim 1, characterized in that it comprises at least one capstan yarn every four stitch wales.

* * * * *